US006773338B2

(12) United States Patent
Yun et al.

(10) Patent No.: US 6,773,338 B2
(45) Date of Patent: Aug. 10, 2004

(54) POLISHING HEAD AND CHEMICAL MECHANICAL POLISHING APPARATUS INCLUDING THE SAME

(75) Inventors: Cheol-Ju Yun, Seoul (KR); Young-Min Kim, Osan (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/357,471

(22) Filed: Feb. 4, 2003

(65) Prior Publication Data

US 2003/0148718 A1 Aug. 7, 2003

(30) Foreign Application Priority Data

Feb. 4, 2002 (KR) ..... 10-2002-0006210

(51) Int. Cl.[7] ..... B24B 1/00

(52) U.S. Cl. ..... 451/288; 451/8; 451/9; 451/285; 451/390; 451/398; 451/41

(58) Field of Search ..... 451/8, 9, 41, 285–290, 451/390, 388, 398

(56) References Cited

U.S. PATENT DOCUMENTS 5,882,243 A 3/1999 Das et al. ..... 451/5
6,050,882 A * 4/2000 Chen ..... 451/41
6,196,905 B1 * 3/2001 Inaba ..... 451/288
6,206,768 B1 * 3/2001 Quek ..... 451/287
6,280,306 B1 * 8/2001 Hosoki et al. ..... 451/288
6,319,106 B2 * 11/2001 Numoto ..... 451/288
6,443,824 B2 * 9/2002 Shendon et al. ..... 451/288
6,579,151 B2 * 6/2003 Tseng et al. ..... 451/11
6,666,756 B1 * 12/2003 Travis ..... 451/283

FOREIGN PATENT DOCUMENTS

JP 9-225820 9/1997

* cited by examiner

*Primary Examiner*—Joseph J. Hall, III
*Assistant Examiner*—Anthony Ojini
(74) *Attorney, Agent, or Firm*—Lee & Sterba, P.C.

(57) ABSTRACT

A polishing head and a chemical mechanical polishing apparatus having the polishing head including a plate having vacuum holes for transferring vacuum pumping force; a porous film having holes corresponding to the vacuum holes and attached to a lower surface of the plate; a retainer ring attached to the lower surface of the plate at an edge portion thereof and having a sloped surface; a clamp ring attached to the lower surface of the plate adjacent the retainer ring for clamping the retainer ring; an adjusting ring having a sloped surface parallel and in contact with the sloped surface of the retainer ring, the adjusting ring being installed between the retainer ring and the plate; and a diameter adjusting device for adjusting a diameter of the adjusting ring by moving the adjusting ring along the sloped surface of the retainer ring, thereby adjusting a height of the retainer ring.

13 Claims, 6 Drawing Sheets

POLISHING HEAD AND CHEMICAL MECHANICAL POLISHING APPARATUS INCLUDING THE SAME

BACKGROUND OF THE INVENTION

1. Field of the Invention

The present invention relates to a polishing head of a chemical mechanical polishing apparatus used for manufacturing semiconductor devices and a chemical mechanical polishing apparatus including the same. More particularly, the present invention relates to a polishing head capable of adjusting a height of a retainer ring after measuring a step height difference between the retainer ring and a semiconductor wafer.

2. Description of the Related Art

The manufacturing process of semiconductor devices demands a degree of integration, a fine pitch and a multi-layered structure of wires. As the demand increases, the surface roughness of a semiconductor wafer becomes increasingly uneven. Therefore, significant attention is paid to a technology for smoothing or planarizing a surface of the semiconductor wafer.

Known planarizing techniques include reflowing, spin on glass (SOG), etch back, and chemical mechanical polishing (CMP). Among these techniques, CMP is widely used in semiconductor device manufacturing due to an advantage of global planarization achievement, particularly in the manufacture of a semiconductor device having four wiring layers.

To perform CMP, a polishing head moves down to the semiconductor wafer, and holds the semiconductor wafer in a retainer ring thereof. Then, the polishing head presses a surface of the semiconductor wafer against a pad covering a polishing table, which is rotating. A polishing slurry is applied onto the pad during the polishing.

In addition, not only does the semiconductor wafer contact the polishing pad, but the retainer ring holding the semiconductor wafer contacts the polishing pad during the polishing, thus causing wear on the retainer ring. As the retainer ring becomes worn, a step height difference between a bottom surface of the retainer ring and the surface of the semiconductor wafer is reduced. As a result, polishing uniformity is degraded.

Several conventional apparatus have been proposed to improve polishing uniformity.

One conventional apparatus includes a polishing head having a pushing force distribution plate on a bottom thereof, the pushing force distribution plate including a plurality of segments in which a thickness of the segments is adjusted by a controller, for improving polishing uniformity by adjusting the pushing force of the semiconductor wafer.

Another conventional apparatus provides a polishing system including a modulation unit that includes a plurality of capacitors each of which includes a flexible lower plate and a plurality of smaller upper plate segments. In the polishing system, a controller monitors and adjusts the capacitance between each of the upper plate segments and the flexible lower plate, so that dynamic and localized control of polishing is achieved.

FIG. 1 illustrates a schematic view of a conventional chemical mechanical polishing (CMP) apparatus. The conventional CMP apparatus includes a polishing table 10 covered with a pad 12 that directly contacts a wafer and is rotated during polishing, a polishing head 14, that is installed over the polishing table 10 and holds a wafer 2 by vacuum suction, and a slurry supplying nozzle 18 installed over the polishing table 10 for supplying slurry from a slurry tank 16 onto the polishing table 10. The polishing head 14 is shown in greater detail in FIG. 2.

Referring to FIG. 2, the polishing head 14 includes an upper plate 20 where a vacuum tube 21 passes through at a portion thereof, and an outer ring 22 being attached to the upper plate 20 by a bolt 22*a* at an edge portion thereof. Inside the outer ring 22, an inner ring 24 is fixed to an inner sidewall of the outer ring 22 by pins 24*a*. Inside the inner ring 24, an inner plate 26 having a penetrating hole 28 connected to one end of the vacuum tube 21 is provided by being fixed to the inner ring 24 using pins 26*a*.

As shown in FIG. 2 and an enlarged portion of FIG. 2, a lower plate 30 is provided under the inner plate 26 being apart from the inner plate 26 a predetermined distance and fixed to the inner plate 26 by bolts 30*a*. The lower plate 30 has a recess around an edge portion thereof and a plurality of vacuum holes 32 at an inner part of the recess. A porous film 34 having a plurality of holes 36 corresponding in location to the vacuum holes 32 of the lower plate 30 is provided under the lower plate 30. The wafer 2 is attached to the porous film 34 by a vacuum pumping force transferred though the vacuum holes 32 of the lower plate 30 and holes 36 of the porous film 34 from the vacuum tube 21.

Referring to the enlarged portion of FIG. 2, a retainer ring 38 is provided at the recess formed on the bottom of the lower plate 30 and clamped by a clamp ring 44 installed on an exterior of the retainer ring 38 wherein an inner tube 42 is interposed between the clamp ring 44 and the retainer ring 38. The clamp ring 44 is fixed to the lower plate 30 by bolts 44*a*. The retainer ring 38 is provided to prevent the wafer 2 from being pulled off outside the lower plate 30. Additionally, a shim 40 is interposed between the lower plate 30 and the retainer ring 38 at the recess to adjust a step height between a bottom of the wafer 2 and a bottom of the retainer ring 38.

The polishing head 14 contacts a back surface of the wafer 2 and tightly holds the wafer 2 using vacuum suction. The wafer 2 is fixed to the porous film 34 attached to the bottom of the polishing head 14 by a vacuum pumping force that is transferred through the vacuum tube 21, the penetrating holes 28 of the inner plate 26, the vacuum holes 32 of the lower plate 30 and holes 36 of the porous film 34.

The polishing head holding the wafer 2 by the bottom thereof using the vacuum pumping force contacts the pad 12 of the polishing table 10, which is rotating and presses the wafer against the pad 12, thereby polishing the surface of the wafer.

At this time, a slurry is supplied onto the polishing table 10 from the slurry tank 16 via the slurry nozzle 18, so that mechanical and chemical polishing is accomplished.

The wafer 2 may not be detached from the polishing head 14, even though the vacuum pumping force is removed from the vacuum tube 21, due to a pressing force of the polishing head 14 and a clamping force of the retainer ring 38 during polishing.

The retainer ring 38, however, is gradually worn-out as the polishing proceeds due to the nonuniform distribution of the pressing force. Further, the retainer ring 38 may be worn-out due to the internal pressure variation of the internal tube 42 pressing the retainer ring 38. As a result, polishing uniformity of the wafer is degraded.

In a case when the retainer ring 38 becomes worn-out, an operator releases the retainer ring 38 from the polishing head 14 and replaces the shim 40 installed between the lower plate 30 and the retainer ring 38, thereby increasing a step height difference between the wafer 2 and the retainer ring 38. However, it is difficult to detect the worn-out status of the retainer ring in real time. Accordingly, inferior polishing frequently occurs.

Further, such replacements are labor-intensive work and an accuracy of adjustment of the step height difference between the wafer and the retainer ring is low because the replacement is performed manually.

SUMMARY OF THE INVENTION

It is a feature of an embodiment of the present invention to provide a polishing head capable of automatically detecting a step height difference between a wafer and a retainer ring and accurately adjusting the step height difference, and a chemical mechanical polishing apparatus including the same polishing head.

In accordance with one aspect of the present invention, there is provided a polishing head for a chemical mechanical polishing apparatus including a plate having a plurality of vacuum holes for transferring a vacuum pumping force; a porous film having a plurality of holes corresponding to the locations of the plurality of vacuum holes, the porous film being attached to a lower surface of the plate; a retainer ring attached to the lower surface of the plate at edge portion thereof and having a sloped surface; a clamp ring attached to the lower surface of the plate adjacent the retainer ring for clamping the retainer ring; an adjusting ring having a sloped surface parallel and in contact with the sloped surface of the retainer ring, the adjusting ring being installed between the retainer ring and the plate; and a diameter adjusting device for adjusting a diameter of the adjusting ring by moving the adjusting ring along the sloped surface of the retainer ring, thereby adjusting a height of the retainer ring.

Preferably, the adjusting ring includes a first half ring having tabs at both ends thereof and a second half ring having notches for receiving the tabs of the first half ring at both ends thereof, wherein the tabs and the notches form an adjustably mating connection to vary the diameter of the adjusting ring.

Preferably, the diameter adjusting device includes a first connection bar and a second connection bar extending upwardly from an upper surface of the first half ring and an upper surface of the second half ring, respectively; a third connection bar and a fourth connection bar connected to the first connection bar and the second connection bar, respectively, the third and fourth connection bars being perpendicular to the first and second connection bars, wherein the third connection bar and the fourth connection bar are arranged longitudinally, and the third connection bar and the fourth connection bar have screw threads on outer surfaces thereof, and wherein a direction of the screw threads of the third connection bar is opposite to a direction of the screw threads of the fourth connection bar; an adjusting bar having a central hole, the central hole of the adjusting bar having screw grooves corresponding to the screw threads of the third connection bar and the fourth connection bar on an inner wall thereof; and a groove formed in a lower portion of the plate for receiving the adjusting bar, the first and second connection bars, and the third and the fourth connection bars.

Preferably, the adjusting bar has gear grooves on an outer surface thereof for receiving a gear therein. Also preferably, the polishing head includes a gear for rotating the adjusting bar, the gear being connected to a rotating shaft that is rotated by an external actuating unit.

In accordance with another aspect of the present invention, there is provided a chemical mechanical polishing apparatus for manufacturing a semiconductor device including a polishing table capable of rotating at a predetermined speed, the polishing table being covered with a pad; a slurry supplying nozzle for supplying a slurry onto the pad of the polishing table; a polishing head, capable of rotating, for holding a wafer and pressing the wafer to the pad of polishing table while rotating, the polishing head having a retainer ring for securing the wafer; and a step height difference measuring device for measuring a height difference between the wafer and the retainer ring.

In accordance with yet another aspect of the present invention, there is provided a chemical mechanical polishing apparatus for manufacturing a semiconductor device, including a polishing table covered with a pad, the polishing table being capable of rotating at a predetermined speed; a slurry supplying nozzle for supplying slurry onto the pad of the polishing table; and a polishing head, including a plate having a plurality of vacuum holes for transferring a vacuum pumping force; a porous film having a plurality of holes corresponding to the locations of the plurality of vacuum holes, the porous film being attached to a lower surface of the plate; a retainer ring attached to the lower surface of the plate at an edge portion thereof and having a sloped surface; a clamp ring attached to the lower surface of the plate adjacent the retainer ring for clamping the retainer ring; an adjusting ring having a sloped surface parallel and in contact with the sloped surface of the retainer ring, the adjusting ring being installed between the retainer ring and the plate; and a diameter adjusting device for adjusting a diameter of the adjusting ring by moving the adjusting ring along the sloped surface of the retainer ring, thereby adjusting a height of the retainer ring.

Preferably, the step height difference measuring device measures the step height difference using a micro gauge that measures electrical signals which are generated in response to a movement variation width of an elastic probe that moves along a surface of the retainer ring and a surface of the wafer.

BRIEF DESCRIPTION OF THE DRAWINGS

The above features and advantages of the present invention will become readily apparent to those of ordinary skill in the art by describing in detail preferred embodiments thereof with reference to the attached drawings in which.

DETAILED DESCRIPTION OF THE INVENTION

Korean Patent Application No. 2002-6210, filed on Feb. 4, 2002, and entitled: "Polishing Head and Chemical Mechanical Polishing Apparatus Including the Same," is incorporated by reference herein in its entirety.

Figure 1:
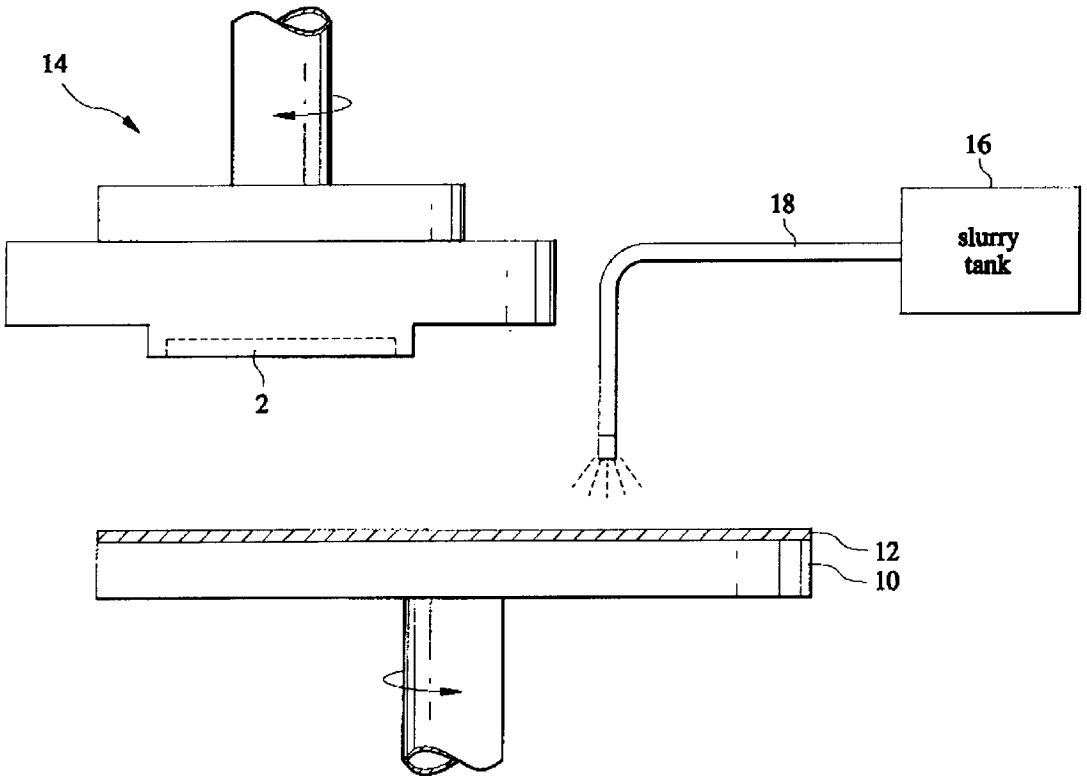
FIG. 1 (PRIOR ART)
FIG. 1 illustrates a schematic view of a conventional chemical mechanical polishing apparatus.
Figure 2:
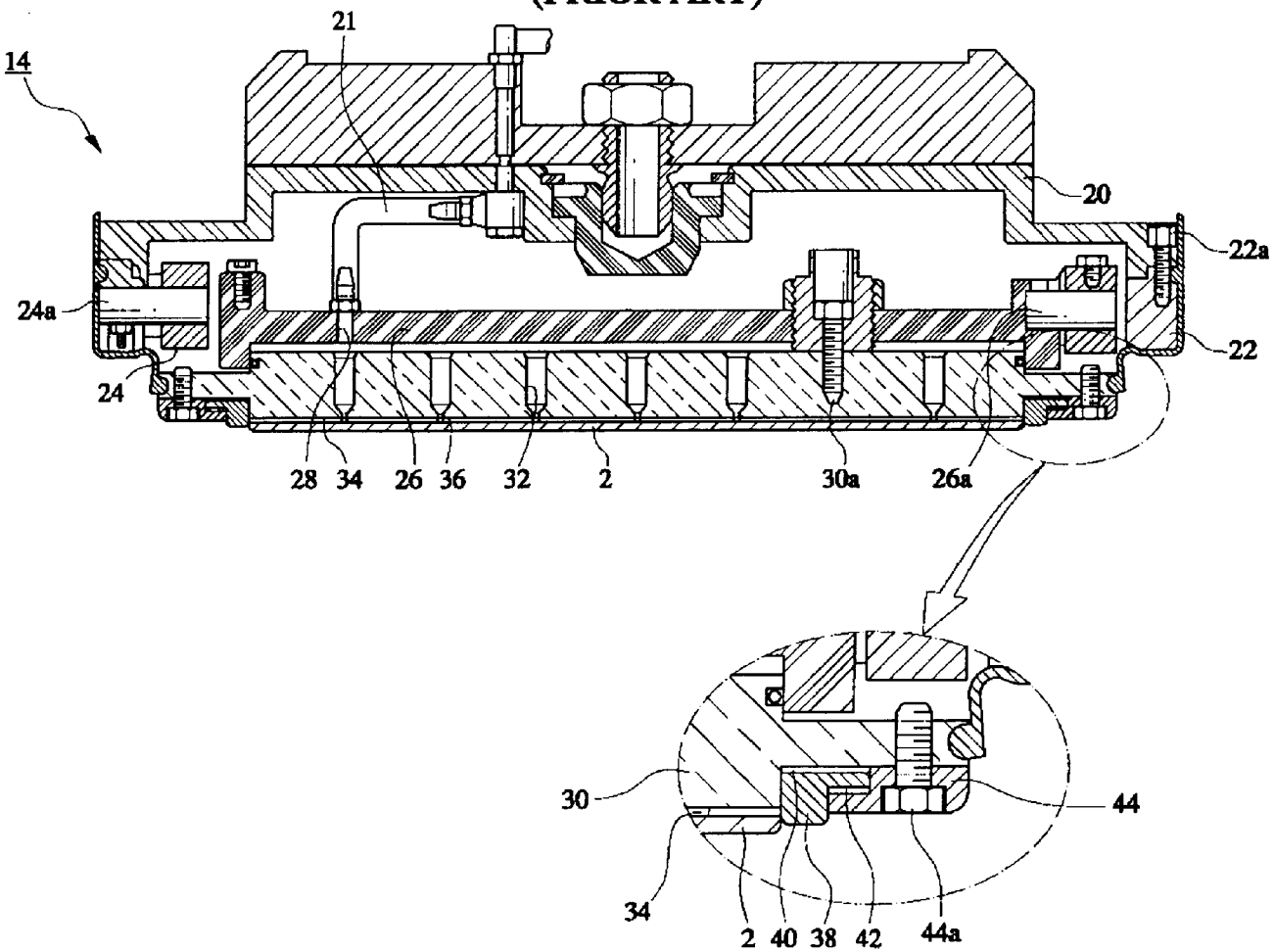
FIG. 2 (PRIOR ART)
FIG. 2 illustrates a detailed view of a conventional polishing head shown in FIG. 1.
Figure 3:
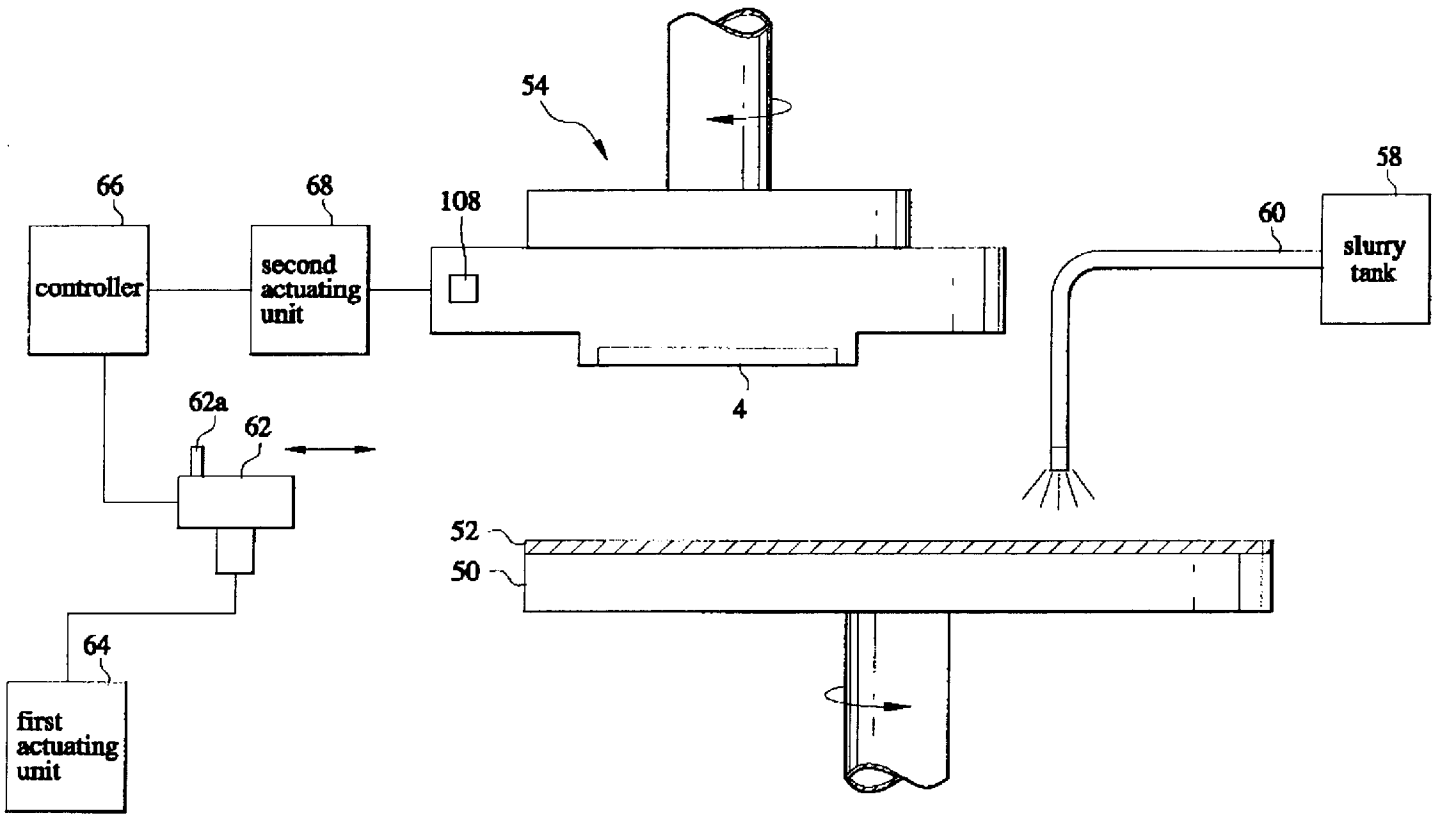
FIG. 3 illustrates a schematic view of a chemical mechanical polishing apparatus in accordance with an embodiment of the present invention.

FIG. 3 illustrates a chemical mechanical polishing (CMP) apparatus in accordance with an embodiment of the present invention. As shown in FIG. 3, the CMP apparatus includes a polishing table 50 capable of being rotated at a predetermined speed in accordance with the present invention. The polishing table 50 is covered with a pad 52, preferably made of polyurethane. The CMP apparatus further includes a slurry nozzle 60 installed above the polishing table 50 for supplying slurry from a slurry tank 58 onto the pad 52.

The CMP apparatus further includes a polishing head 54 installed above the polishing table 50. The polishing head 54 is able to hold a wafer 4 using a vacuum pumping force, move the wafer 4 onto the polishing table 50, and rotate the wafer 4 on the pad 52 while pressing the wafer 4 against the pad 52.

Figure 4:
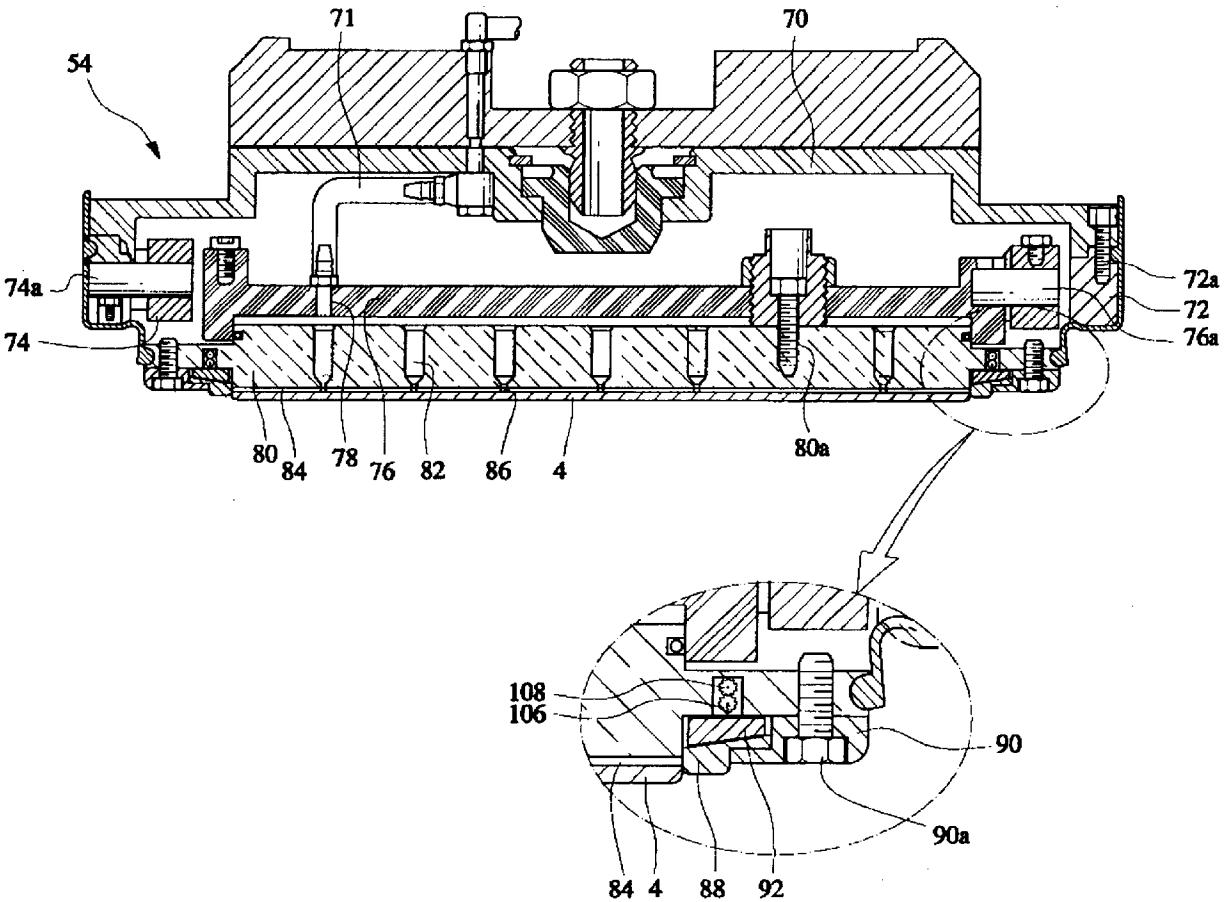
FIG. 4 illustrates a cross-sectional view of a polishing head shown in FIG. 3.

The CMP apparatus further includes a micro gauge 62 for measuring a step height difference between the wafer 4 and a retainer ring 88 (shown in FIG. 4). The micro gauge 62 is a device capable of measuring the step height difference between the wafer 4 and the retainer ring 88. An elastic probe 62*a* of the gauge 62 is moved from the bottom of the retainer ring 88 to a surface of the wafer 4, thereby measuring the step height difference by detecting electrical signals generated in response to the height variation of the elastic probe 62*a*. A first actuating unit 64 controls the movement of the micro gauge 62.

Alternatively, instead of using a micro gauge 62, a displacement sensor that measures the step height difference using beams of light may be used.

Preferably, the micro gauge 62 transmits electrical signals corresponding to the step height difference to a controller 66, which actuates a second actuating unit 68 to rotate a gear 108 capable of adjusting the height of the retainer ring 88.

Referring to FIG. 4, the polishing head 54 includes an upper plate 70, an outer ring 72, an inner ring 74, an inner plate 76, a lower plate 80, a porous film 84, a retainer ring 88, a clamp ring 90 and an adjusting ring 92 capable of raising or lowering the retainer ring 88.

The upper plate 70 has a hole through which a vacuum tube 71 passes. The outer ring 72 is secured to an edge portion of the upper plate 70 by bolts 72*a*.

The inner ring 74 is installed inside the outer ring 72 and is secured to the outer ring 72 by pins 74*a*. The inner plate 76 is secured to the inner ring 74 by pins 76*a*. The inner plate 76 has a penetrating hole 78 connected to one end of the vacuum tube 71.

The lower plate 80 has recesses on upper and lower surfaces thereof along an edge portion thereof and a plurality of vacuum holes 82 at a portion thereof not corresponding to the locations of the recesses. The lower plate 80 is installed under the inner plate 76 having a distance between them.

The lower plate 80 is secured to the inner plate 76 by bolts 80*a*.

The porous film 84 having a plurality of holes 86, each corresponding to the location of a vacuum hole 82, is attached to a lower surface of the lower plate 80 except for at a location corresponding to the recesses. The wafer 4 is fixed to the porous film using a vacuum pumping force.

The retainer ring 88 is provided under the lower plate 80 at a location corresponding to one of the recesses to surround the wafer and clamp the wafer to the lower plate 80 by a pushing force of a clamp ring 90. The clamp ring 90 is secured to the lower plate 80 by bolts 90*a*.

The retainer ring 88 has a sloped upper surface with an inclination of a predetermined degree and a stepped; horizontal lower surface. That is, a thickness of the retainer ring 88 at an inner edge is less than a thickness at an outer edge thereof.

Between the sloped upper surface of the retainer ring 88 and the lower surface of the lower plate 80, the adjusting ring 92 is provided. A lower surface of the adjusting ring 92 is sloped to be parallel to the upper surface of the retainer ring 88.

Further, gear receiving grooves are formed at the recess of the lower plate 80, so that an adjusting bar 106 and a gear 108 for adjusting height of the retainer ring 88 are received in the gear receiving grooves between the lower plate 80 and the adjusting ring 92. The adjusting ring 92 moves up and down as the adjusting bar 106 is rotated. As the adjusting ring 92 moves up and down, height of the retainer ring 88 is varied.

Figure 5:
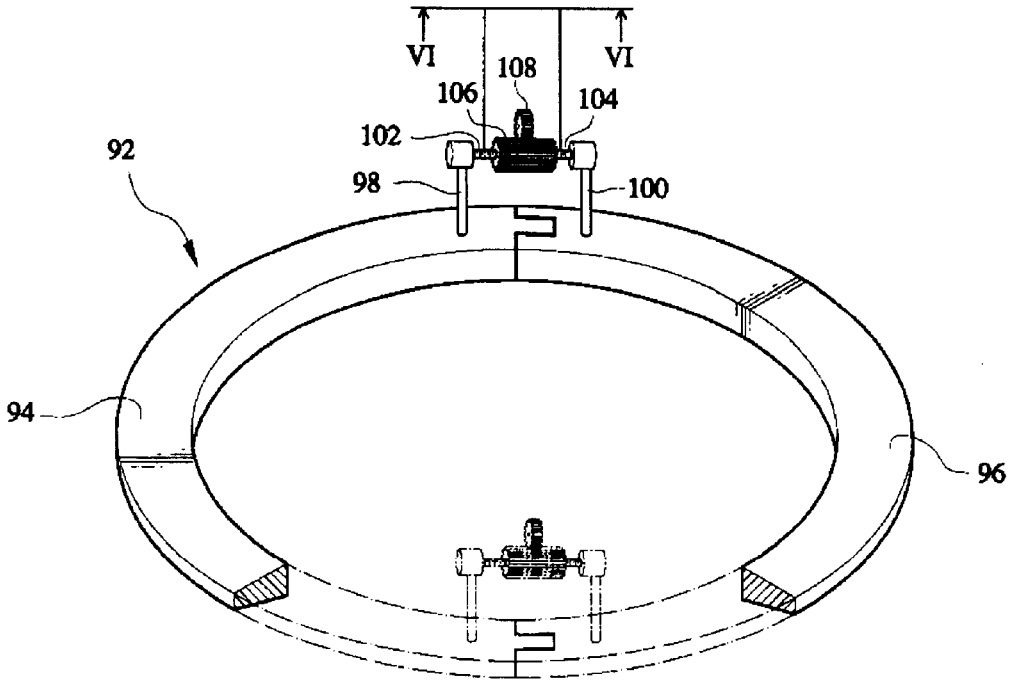
FIG. 5 illustrates a perspective view of an adjusting ring included in the polishing head in FIG. 3.
Figure 6:
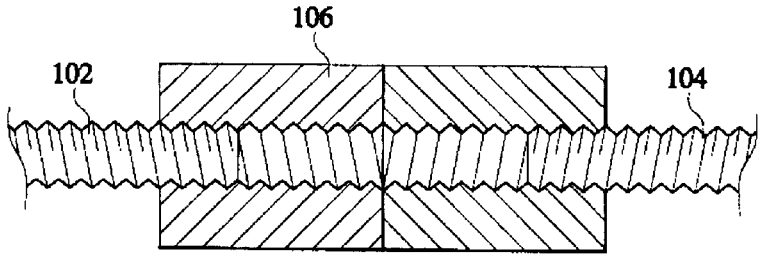
FIG. 6 illustrates a cross-sectional view of an adjusting bar and connection bars taken along a line VI—VI in FIG. 5.

As shown in FIGS. 5 and 6, the adjusting ring 92 includes a first half ring 94 having tabs at both ends thereof and a second half ring 96 having notches for receiving the tabs at both ends thereof. The notches are positioned to correspond to the tabs and form an adjustable mating connection therewith. At the point of connection between the tabs and the notches, a first connection bar 98 and a second connection bar 100, which is parallel to the first connection bar 98, extend upwardly from an upper surface of the first and second half rings 94, 96, respectively. A third connection bar 102 and a fourth connection bar 104, which is in line with the third connection bar 102, are connected to the first connection bar 98 and the second connection bar 100, respectively, by linking devices. The third connection bar 102 and the fourth connection bar 104 are perpendicular to the first connection bar 98 and the second connection bar 100. The third connection bar 102 and the fourth connection bar 104 are linked to each other by the adjusting bar 106 and function as a shaft for rotating the adjusting bar 106.

FIG. 6 illustrates a cross-sectional view of the adjusting bar 106 and the third and fourth connection bars 102, 104 taken along line VI—VI of FIG. 5. As shown in FIG. 6, the third connection bar 102 and the fourth connection bar 104 have screw threads on outer surfaces thereof. The screw threads of the third connection bar 102 and the fourth connection bar 104 are opposite to each other. The adjusting bar 106 has a central hole and screw grooves, which are formed to correspond to the screw threads of the third connection bar 102 and the fourth connection bar 104, are formed on inner walls of the central hole.

Accordingly, the third connection bar 102 and the fourth connection bar 104 are moved longitudinally toward the interior of the adjusting bar 106 or the exterior of the adjusting bar 106 as the adjusting bar 106 rotates.

Figure 7:
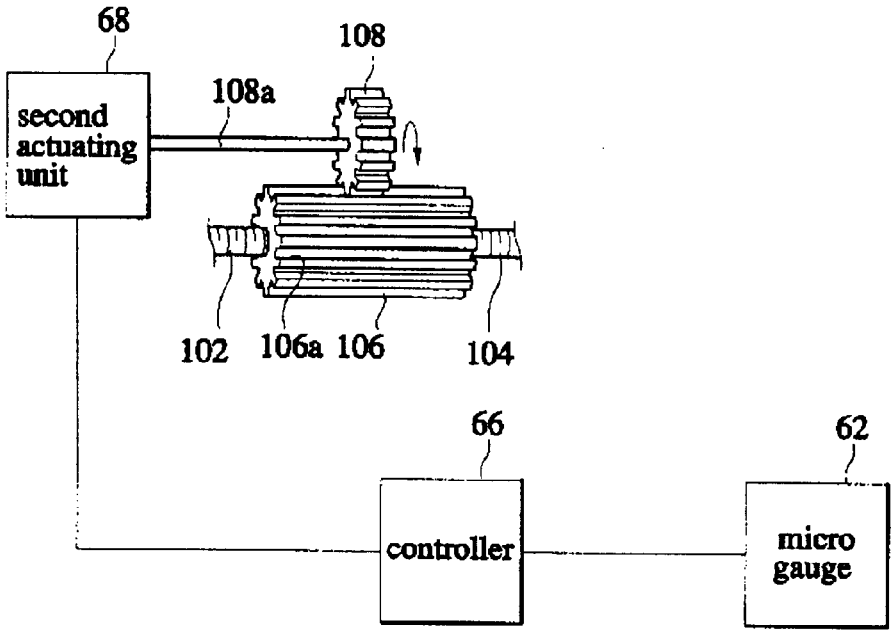
FIG. 7 is a block diagram for explaining operation of a micro gauge and a step height adjusting device for measuring and adjusting the step height difference between the retainer ring and the wafer in accordance with the present invention.

FIG. 7 is a block diagram for explaining the operation of taking a measurement of a step height difference between the retainer ring and the wafer and the subsequent adjustment of the step height difference. As shown in FIG. 7, the adjusting bar 106 has gear grooves 106*a* on an outer surface thereof for receiving a gear 108 therein. The gear grooves 106*a* extend in a longitudinal direction of the adjusting bar 106, so that the gear 108 may be rotated by linking with the gear grooves 106*a* along the periphery of the adjusting bar 106. As shown in FIG. 7, when the step height difference value between the retainer ring 88 and the wafer 4 is measured by the micro gauge 62, the measured value is transmitted to the controller 66. Then, the controller controls a second actuating unit 68 to actuate a shaft 108*a* connected to the gear 108 so that the gear 108 is rotated.

The method of adjusting the step height difference between the wafer and the retainer ring will be described in detail below with reference back to FIG. 4.

The polishing head 54 holds the wafer 4 using a vacuum pumping force on the back surface of the wafer 4. At this time, the back surface of wafer 4 is attached to the porous film 84. The vacuum pumping force is transferred to the back surface of the wafer 4, via the penetrating hole 78 of the inner plate 76, the vacuum holes 82 of the lower pate 80, and the holes 86 of the porous film 84, from the vacuum tube 71.

Next, the polishing head 54 transports the wafer 4 to the pad 52 on the polishing table 50, begins to rotate the wafer 4, and then presses the rotating wafer 4 down against the pad 52.

During the rotation of the wafer 4, the slurry is applied onto the pad 52, so that chemical and mechanical polishing is accomplished.

During the polishing, the vacuum pumping force is usually stopped, but the wafer 4 remains fixed to the polishing head 54 due to the downward pressing force of the polishing head 54 and the clamping force of the retainer ring 88.

After the polishing is completed, the wafer 4 is fixed again to the polishing head 54 by the vacuum pumping force, and the micro gauge 62 is moved to the lower surface of the polishing head 54 by the first actuating unit 64. The micro gauge 62 then measures the step height difference between the retainer ring 88 and the wafer 4.

Preferably, the elastic probe 62*a* of the micro gauge 62 moves from the lower surface of the retainer ring 88 to the lower surface of the wafer 4, which is attached to the porous film 84, thereby measuring the step height difference by the movement variation width of the probe 62*a*.

Next, in one embodiment of the present invention, the step height difference value measured by the micro gauge 62 is transmitted to the controller 66 in the form of electrical signals. Based on the electrical signals the controller actuates the second actuating unit 68 to rotate the rotating shaft 108*a* in either a forward or backward direction. In response to the rotation of the rotating shaft 108*a*, the gear 108 rotates in the same direction as the rotating shaft 108*a*. As the gear 108 rotates in either the forward or backward direction, the adjusting bar 106 having gear grooves 106*a* linking with the gear 108, rotates in an opposite direction to the direction of rotation of the gear 108. At this time, the third connection bar 102 and the fourth connection bar 104 move longitudinally in or out of the adjusting bar 106.

The first half ring 94 and the second half ring 96 connected to the third connection bar 102 and the fourth connection bar 104, respectively, via the first connection bar 98 and the second connection bar 100, move along the sloped surface of the retainer ring 88. Accordingly, the diameter of the adjusting ring 92 increases or decreases in response to the movement of the first and the second half rings 94 and 96. That is, as the distance between the tabs of the first half adjusting ring 94 and the notches of the second half adjusting ring 96 increases, the adjusting ring 92 moves toward the outer edge of the retainer ring 88 along the slope surface of the retainer ring 88. Therefore, the height difference of the retainer ring 88 with respect to the lower surface of the wafer 4 increases, i.e., the retainer ring 88 is lowered.

Alternatively, as the distance between the tabs of the first half adjusting ring 94 and the notches of the second half adjusting ring 96 decreases, the adjusting ring 92 moves toward the inner edge of the retainer ring 88. Therefore, the height difference of the retainer ring 88 with respect to the wafer 4 decreases, i.e., the retainer ring 88 is raised.

After performing an adjustment to the step height difference between the retainer ring 88 and the wafer 4, polishing is repeated.

Preferred embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A polishing head for a chemical mechanical polishing apparatus, comprising:

a plate having a plurality of vacuum holes for transferring a vacuum pumping force;

a porous film having a plurality of holes corresponding to the locations of the plurality of vacuum holes, the porous film being attached to a lower surface of the plate;

a retainer ring attached to the lower surface of the plate at an edge portion thereof and having a sloped surface;

a clamp ring attached to the lower surface of the plate adjacent the retainer ring for clamping the retainer ring;

an adjusting ring having a sloped surface parallel and in contact with the sloped surface of the retainer ring, the adjusting ring being installed between the retainer ring and the plate; and a diameter adjusting device for adjusting a diameter of the adjusting ring by moving the adjusting ring along the sloped surface of the retainer ring, thereby adjusting a height of the retainer ring.

2. The polishing head according to claim 1, wherein the adjusting ring comprises:

a first half ring having tabs at both ends thereof; and a second half ring having notches for receiving the tabs of the first half ring at both ends thereof, wherein the tabs and the notches form an adjustably mating connection to vary the diameter of the adjusting ring.

3. The polishing head according to claim 2, wherein the diameter adjusting device comprises:

a first connection bar and a second connection bar extending upwardly from an upper surface of the first half ring and an upper surface of the second half ring, respectively;

a third connection bar and a fourth connection bar connected to the first connection bar and the second connection bar, respectively, the third and fourth connection bars being perpendicular to the first and second connection bars, wherein the third connection bar and the fourth connection bar are arranged longitudinally, and the third connection bar and the fourth connection bar have screw threads on outer surfaces thereof, and wherein a direction of the screw threads of the third connection bar is opposite to a direction of the screw threads of the fourth connection bar;

an adjusting bar having a central hole, the central hole of the adjusting bar having screw grooves corresponding to the screw threads of the third connection bar and the fourth connection bar on an inner wall thereof; and a groove formed in a lower portion of the plate for receiving the adjusting bar, the first and second connection bars, and the third and the fourth connection bars.

4. The polishing head according to claim 3, wherein the adjusting bar has gear grooves on an outer surface thereof for receiving a gear therein.

5. The polishing head according to claim 4, further comprising a gear for rotating the adjusting bar, the gear being connected to a rotating shaft that is rotated by an external actuating unit.

6. A chemical mechanical polishing apparatus for manufacturing a semiconductor device, comprising:

a polishing table capable of rotating at a predetermined speed, the polishing table being covered with a pad;

a slurry supplying nozzle for supplying a slurry onto the pad of the polishing table;

a polishing head, capable of rotating, for holding a wafer and pressing the wafer to the pad of polishing table while rotating, the polishing head having a retainer ring for securing the wafer; and a step height difference measuring device for measuring a height difference between the wafer and the retainer ring.

7. The chemical mechanical polishing apparatus according to claim 6, wherein the step height difference measuring device measures the step height difference using a micro gauge that measures electrical signals which are generated in response to a movement variation width of an elastic probe that moves along a surface of the retainer ring and a surface of the wafer.

8. A chemical mechanical polishing apparatus for manufacturing a semiconductor device, comprising:

a polishing table covered with a pad, the polishing table being capable of rotating at a predetermined speed;

a slurry supplying nozzle for supplying slurry onto the pad of the polishing table; and a polishing head, including:

a plate having a plurality of vacuum holes for transferring a vacuum pumping force;

a porous film having a plurality of holes corresponding to the locations of the plurality of vacuum holes, the porous film being attached to a lower surface of the plate;

a retainer ring attached to the lower surface of the plate at an edge portion thereof and having a sloped surface;

a clamp ring attached to the lower surface of the plate adjacent the retainer ring for clamping the retainer ring;

an adjusting ring having a sloped surface parallel and in contact with the sloped surface of the retainer ring, the adjusting ring being installed between the retainer ring and the plate; and a diameter adjusting device for adjusting a diameter of the adjusting ring by moving the adjusting ring along the sloped surface of the retainer ring, thereby adjusting a height of the retainer ring.

9. The chemical mechanical polishing apparatus according to claim 8, wherein the adjusting ring comprises:

a first half ring having tabs at both ends thereof; and a second half ring having notches for receiving the tabs of the first half ring at both ends thereof, wherein the tabs and the notches form an adjustably mating connection to vary the diameter of the adjusting ring.

10. The chemical mechanical polishing apparatus according to claim 9, wherein the diameter adjusting device comprises:

a first connection bar and a second connection bar extending upwardly from an upper surface of the first half ring and an upper surface of the second half ring, respectively;

a third connection bar and a fourth connection bar connected to the first connection bar and the second connection bar, respectively, the third and fourth connection bars being perpendicular to the first and second connection bars, wherein the third connection bar and the fourth connection bar are arranged longitudinally, and the third connection bar and the fourth connection bar have screw threads on outer surfaces thereof, and wherein a direction of the screw threads of the third connection bar is opposite to a direction of the screw threads of the fourth connection bar;

an adjusting bar having a central hole, the central hole of the adjusting bar having screw grooves corresponding to the screw threads of the third connection bar and the fourth connection bar on an inner wall thereof; and a groove formed in a lower portion of the plate for receiving the adjusting bar, the first and second connection bars, and the third and the fourth connection bars.

11. The chemical mechanical polishing apparatus according to claim 10, wherein the adjusting ring has gear grooves on an outer surface thereof for receiving a gear therein.

12. The chemical mechanical polishing apparatus according to claim 11, further comprising a gear for rotating the adjusting bar, the gear being connected to a rotating shaft that is rotated by an external actuating unit.

13. The chemical mechanical polishing apparatus according to claim 8, wherein the step height difference measuring device measures the step height difference using a micro gauge that measures electrical signals which are generated in response to a movement variation width of an elastic probe that moves along a surface of the retainer ring and a surface of the wafer.

* * * * *